US005745139A

United States Patent [19]

Sasaki

[11] Patent Number: 5,745,139

[45] Date of Patent: Apr. 28, 1998

[54] INK FEED CONNECTING MEMBER

[75] Inventor: Toyonori Sasaki, Anjo, Japan

[73] Assignee: Brother Kogyo Kabushiki Kaisha, Nagoya, Japan

[21] Appl. No.: 531,773

[22] Filed: Sep. 21, 1995

[30] Foreign Application Priority Data

Dec. 12, 1994 [JP] Japan ..... 6-307599
Jun. 2, 1995 [JP] Japan ..... 7-136818

[51] Int. Cl.[6] ..... B41J 2/175; B65D 53/00

[52] U.S. Cl. ..... 347/86; 215/341; 220/378

[58] Field of Search ..... 347/86, 87; 141/383, 141/386, 85, 88, 18; 222/325, 108; 215/341, 343–345, DIG. 1; 220/378

[56] References Cited

U.S. PATENT DOCUMENTS 2,722,346 11/1955 Yokota ..... 222/108
3,190,481 6/1965 McKnight, Jr. ..... 215/345
3,247,992 4/1966 Exton ..... 215/320
5,155,502 10/1992 Kimura et al. .

FOREIGN PATENT DOCUMENTS 605 183 7/1994 European Pat. Off. ..... 347/86
A-5-338191 12/1993 Japan ..... 347/86
6-238909 8/1994 Japan ..... 347/86

OTHER PUBLICATIONS

IBM Technical Disclosure Bulletin (Jun. 1991); Replaceable ink cartridge for ink jet print head; pp. 459–462.

*Primary Examiner*—Benjamin R. Fuller
*Assistant Examiner*—Judy Nguyen
*Attorney, Agent, or Firm*—Oliff & Berridge, PLC

[57] ABSTRACT

In a sealing member of an ink feed connecting member, an ink sealing section surrounds at least a part of an ink guide when an ink cartridge is not attached to the ink feed connecting member. The ink sealing member is disposed such that an opening of the ink sealing section is opposite to an ink feed port. The circumferential edge of the ink sealing member is invertedly deformed as the ink cartridge is attached to the ink feed connecting member. When the ink cartridge is fully attached to the ink feed connecting member, the ink sealing section enters the ink cartridge while an inner circumferential edge of the ink sealing member is in contact with an inner peripheral surface of the ink feed port. The surface of the inverted circumferential edge seals the inner peripheral surface of the ink feed port.

20 Claims, 5 Drawing Sheets

INK FEED CONNECTING MEMBER

BACKGROUND OF THE INVENTION

1. Field of the Invention

The present invention relates to an ink feed connecting member for connecting an ink jet recording head with a detachable ink cartridge having an ink feed port for feeding ink to the recording head.

2. Description of Related Art

Conventional printers include a recording head for printing on a recording medium and an ink feed source provided separately from the recording medium for feeding ink to the recording head. When the ink becomes empty in the ink feed source, the ink feed source can be replaced. The recording head and the ink feed source are connected together by an ink feed system consisting of a feed pipe or similar structure.

A conventional ink feed system has an ink feed connecting member 104 as shown in FIGS. 6 to 8. The ink feed connecting member 104 may be made of rubber, synthetic resin, or the like, and is arranged on an end of a head holder 102 facing the recording head 1. The ink feed connecting member 104 is disposed to surround an ink feed path 102A that communicates with the recording head 1. An opening of the ink feed connecting member 104 communicates with the end of the ink feed path 102A. A porous member 6 is fitted into the opening. When an ink cartridge 14 is attached to the head holder 102, the outer periphery of the ink feed connecting member 104 fits into an ink feed port 14A of the ink cartridge 14. The porous member 6 compresses an absorbing member 15 provided in the ink cartridge 14 and acquires ink to supply the ink to the recording head 1.

However, in the ink jet device having the head holder 102 and the ink cartridge 14 separable from each other, the porous member 6 compresses the absorbing member 15 in the ink cartridge 14 when the ink cartridge 14 is attached to the head holder 102. This compressing action sometimes causes ink contained in the absorbing member 15 to flow out of the ink feed port 14A. As a result, the ink 20 adheres to an outer wall surface 14B of the ink cartridge 14 and the outer peripheral surface of the ink feed connecting member 104 when the ink cartridge 14 is detached from the head holder. In some cases, the ink adhering to the outer wall surface 14B of the ink cartridge 14 comes off the outer wall surface 14B outside the printer resulting in dirty surroundings. Additionally, the ink adhering to the outer peripheral surface of the ink feed connecting member 104 may flow out rendering the surroundings of the printer filthy. Thus, surrounding areas of the ink feed connecting member 104 and the head holder 102 may be in a stained state (FIG. 8).

SUMMARY OF THE INVENTION

An object of the present invention is to provide a highly reliable ink feed connecting member that prevents stains due to ink drops from occurring when an ink cartridge is attached or detached. This provides an improved appearance when the ink cartridge is detached and prevents leakage of ink even when the ink cartridge is attached.

An ink feed connecting member for connecting an ink recording head with a detachable ink cartridge has an ink feed port for feeding ink to the recording head. The connecting member also has an ink guide with an ink guide port for guiding ink to the recording head. The ink guide is insertable into the ink cartridge through the ink feed port. A sealing section surrounds at least a part of the ink guide and is disposed opposite the ink feed port to extend beyond the ink guide in which the circumferential edge of the ink cartridge fits to the ink feed port. The sealing section invertedly enters the ink cartridge when the ink cartridge is attached to the ink feed connecting member. The surface of the inverted circumferential edge and the inner peripheral surface of the ink feed port are in close contact with each other. The sealing section may be formed from thermoplastic rubber or cold setting silicon rubber.

Moreover, the distance between the front end of the ink guide and the sealing section is less than the distance between the ink feed port of the ink cartridge and an ink absorbing member.

When the ink cartridge is attached to the ink feed connecting member, the ink guide enters the ink feed port. Ink contained in the ink cartridge is introduced to the recording head through the ink guide. At that time, the circumferential edge of the sealing section extending outside the ink guide fits into the ink feed port as the ink cartridge is attached to the ink feed connecting member. The inner peripheral surface of the inverted circumferential edge seals the inner peripheral surface of the ink feed port. As a result, the inner peripheral surface of the sealing section is brought into close contact with the inner peripheral surface of the ink feed port to prevent leakage of ink from this juncture. Further, even when the ink cartridge is removed, the ink feed port is kept sealed until the sealing section is separated from the ink feed port. Hence, spillage and leakage of ink is prevented. Moreover, the ink sealing section covers at least a part of the ink guide and therefore prevents the ink guide from being stained.

Since the sealing section is preferably made of a thermoplastic rubber member or cold setting silicon rubber, the sealing section has plenty of adhesion to the inner peripheral surface of the ink feed port. This results in improved sealing against the spillage of ink. Also, superior resilience of the sealing section enables continuous use of the sealing section without impairing the recovery of the sealing.

The distance between the front end of the ink guide and the sealing section may be less than the distance between the ink feed port of the ink cartridge and the ink absorbing member. Thus, when the ink cartridge is attached to the ink feed connecting member, the sealing section comes into contact with the ink feed port before the ink guide comes into contact with the ink absorbing member in the ink cartridge. Thus, the sealing section seals the ink feed port before the ink flows out of the ink absorbing member to prevent the leakage of ink from the juncture.

The ink feed connecting member is provided with the sealing section disposed opposite to the ink feed port of the ink cartridge so as to surround at least a part of the ink guide and extend to the outer peripheral surface of the ink guide. The inner peripheral surface of the ink feed port is sealed by the sealing section as the ink cartridge is attached to the ink feed connecting member. Further, even when the ink cartridge is removed, the ink feed port is kept sealed until the sealing section is separated from the ink feed port to prevent the leakage of ink from the juncture. The sealing section covers at least a part of the ink guide. Hence, it is possible to prevent the ink guide from being stained with ink. Thus, the surroundings of the printer and the hands and clothes of an operator will not be stained with ink. The printer will therefore have an improved appearance.

Other objects, advantages and salient features of the invention will become apparent from the following detailed description taken in conjunction with the annexed drawings, which disclose preferred embodiments of the invention.

BRIEF DESCRIPTION OF THE DRAWINGS

Preferred embodiments of the present invention will be described in detail with reference to the following Figures in which like reference numerals refer to like elements and wherein.

DETAILED DESCRIPTION OF PREFERRED EMBODIMENTS

Figure 1:
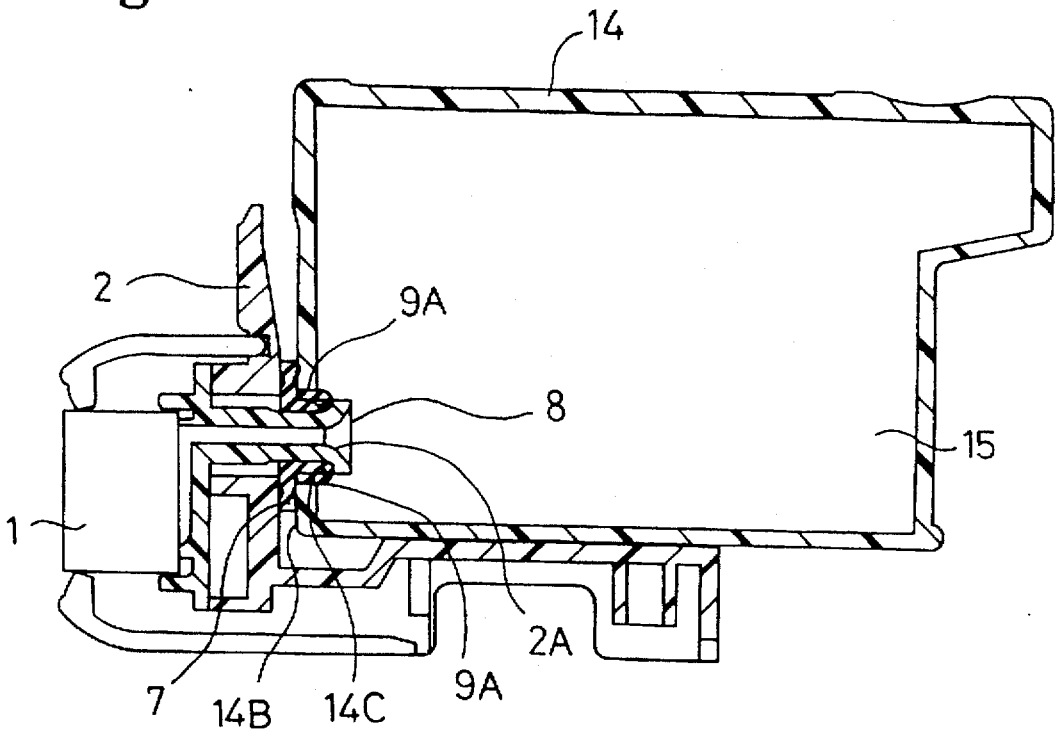
FIG. 1 is a cross-sectional view showing an ink cartridge in a first embodiment of the present invention when attached to a head holder.

Preferred embodiments of the present invention will now be described with reference to the drawings. The same reference numerals are provided to designate corresponding features of the conventional printer.

Figure 3:
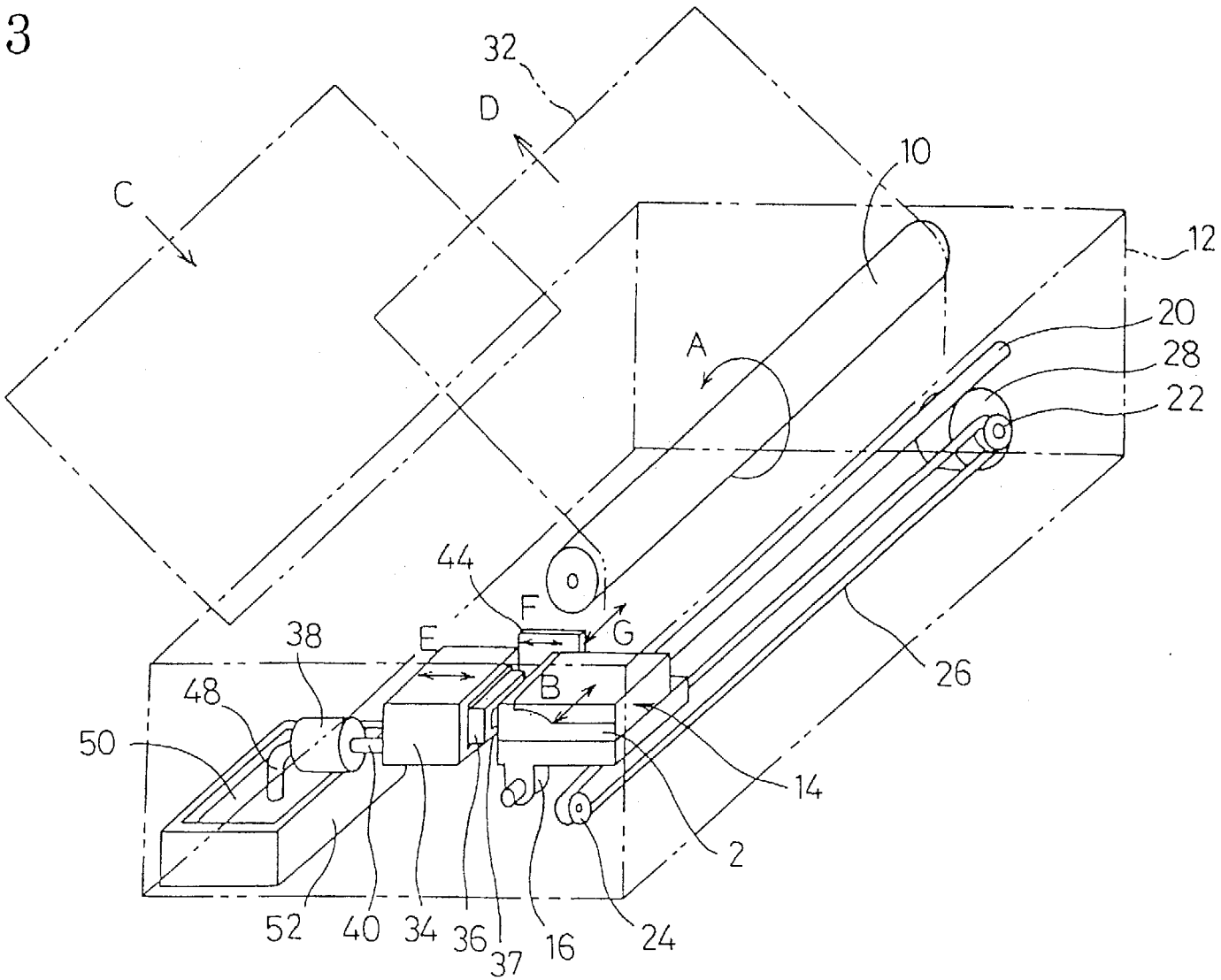
FIG. 3 is a schematic representation showing a printer unit.

FIG. 3 shows the structure of a recorder provided with an ink feed connecting member of the present invention. The ink feed member is shown more clearly as sealing member 7 in FIG. 1. A platen 10 is disposed in a printer housing 12 in such a way as to be rotatable in the direction designated by arrow A. A guide shaft 20 is provided along the platen 10. A carriage 16 is attached to the guide shaft 20 in a slidable manner and is provided with a belt 26. The belt 26 is extended between an idle pulley 24 and a drive pulley 22. The drive pulley 22 is rotated by a drive motor 28 that moves the carriage 16 along the guide shaft 20 in the direction indicated by arrow B via the belt 26. A head holder 2 is disposed on top of the carriage 16 opposite the platen 10. An ink cartridge 14 storing ink for printing is mounted on the head holder 2. The ink cartridge 14 feeds ink to a recording head 1 fixedly attached to the head holder 2. The ink cartridge 14 can be attached to or detached from the head holder 2.

Print paper 32 is inserted into the housing 12 from the rear side of the printer in the direction designated by arrow C and is carried along the platen 10 in the direction designated by arrow D. The print paper 32 is then ejected from the housing 12. When the print paper 32 is carried to the platen 10, the recording head 1 fixed to the head holder 2 jets out ink as the cartridge 16 moves to print desired data on print paper 32.

Figure 2:
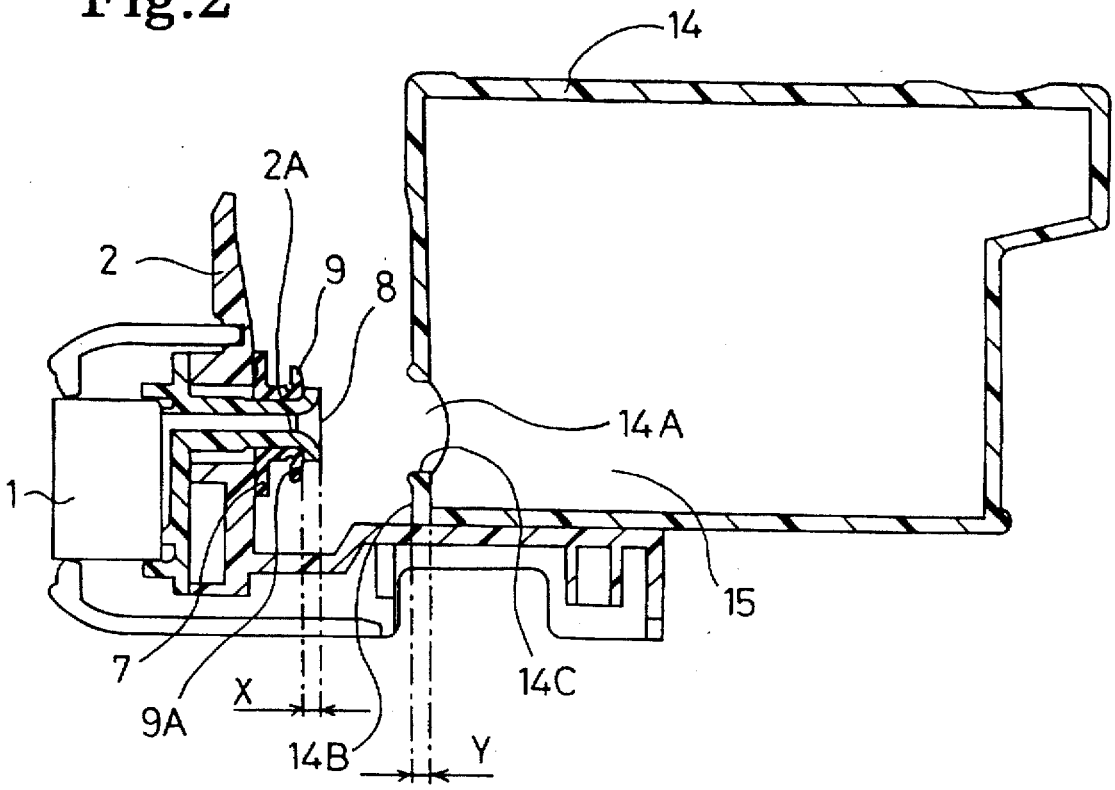
FIG. 2 is a cross-sectional view showing the ink cartridge in the first embodiment after having been detached from the ink cartridge.

The recording head 1 is fixed to the head holder 2. As shown in FIGS. 1 and 2, this head holder 2 is integrated with an ink guide section 2A for feeding ink to the recording head 1. An ink feed path is formed within the ink guide section 2A for supplying ink from the ink cartridge 14 to the recording head 1. A filter 8 is disposed at the end of the ink feed path. A sealing member 7 is provided along the outer peripheral surface of the ink guide section 2A. This sealing member 7 may be made of a rubber member possessing the appropriate elasticity. The sealing member 7 should preferably be sufficiently durable with respect to the ink to be used. For instance, if the sealing member 7 is made of a thermoplastic rubber member or cold setting silicon rubber, it will have better adhesion to the inner peripheral surface of the ink feed port and effectively prevent ink from leaking. Since such a sealing member is superior in elasticity, the sealing member 7 can be repeatedly used without impairing its restoring force.

The sealing member 7 can be inserted into the ink cartridge 14 through the ink feed opening 14A. The sealing member 7 is provided with an ink sealing section 9 extending outward from the ink guide section 2A. The ink sealing section 9 is formed to have flexibility in such a way that its shape easily changes upon receipt of pressure, but is formed to have a sufficient restoring force such that it can promptly restore its original shape when pressure is eliminated. When the ink cartridge 14 is attached to the head holder, an absorbing member 15 may be pressed by the ink guide section 2A and the filter 8 provided at the end of the ink guide section 2A to cause ink drops. To prevent the ink drops, the ink sealing section 9 and the ink feed port 14A of the ink cartridge 14 are positioned to have a relationship such that $X<Y$, where X is the distance between the end of the ink guide section 2A and the end of the ink sealing section 9 that faces the ink cartridge 14, and where Y is the distance between the outer wall surface 14B of the ink cartridge 14 and the absorbing member 15 (i.e., the thickness of the inner peripheral surface of the ink feed port 14A).

A further explanation will now be given of the positional relationship between the ink sealing section and the ink feed port.

When the ink cartridge 14 is not attached to the head holder 2, the sealing section 9 appears as a thin plate when viewed in cross section and surrounds the ink guide section 2A such that the opening of the sealing section 9 is opposite the ink cartridge 14. The circumferential edge of the opening of the ink sealing section 9 has a greater diameter than the ink feed port 14A.

When the ink cartridge 14 is attached to the head holder 2, the filter 8 provided at the end of the ink guide section 2A is inserted into the ink feed port 14. Before the filter 8 comes into contact with the absorbing member 15, the ink sealing section 9 of the sealing member 7 comes into contact with the circumferential edge of the ink feed port 14A of the ink cartridge 14. As a result of the ink sealing section 9 being pressed against the circumferential edge of the ink feed port 14A, the circumferential edge of the ink sealing section 9 is invertedly deformed as shown in FIG. 1. When the ink cartridge 14 is further pressed, the invertedly deformed circumferential end surface 9A of the ink sealing section 9 enters the ink cartridge 14 while remaining in contact with the inner circumferential surface 14C of the ink feed port 14A. At the same time, the filter 8 compresses the absorbing body 15. When the ink cartridge 14 is attached, the inverted circumferential surface 9A of the ink sealing section 9 fits into the inner circumferential surface 14C of the ink feed port 14A to seal the ink feed port 14A. In particular, since the ink sealing section 9 attempts to return to its original form due to its restoring force, the circumferential surface 9A of the ink sealing section 9 comes into close contact with the inner circumferential surface 14C of the ink feed port 14A even while being flexibly deformed in an inverted manner. In this way, ink drops from the juncture between the head holder 2 and the ink cartridge 14 are prevented.

When the ink sealing section 9 enters the ink cartridge 14 and the ink guide section 2A and the filter 8 compress the absorbing body 15 housed in the ink cartridge 14, the density of the compressed absorbing body 15 increases. This causes capillary action that in turn guides the ink contained in the absorbing body 15 into the filter 8 of the ink guide section 2A. At this time, the circumferential surface 9A of the ink sealing section 9 is in close contact the inner peripheral surface 14C of the ink feed port 14A so the ink feed port 14A is sealed. Therefore, the ink guided to the filter 8 of the absorbing body 15 is prevented from overflowing from the ink feed port 14A.

Referring to FIG. 2, when the ink cartridge 14 is removed from the head holder 2, the ink sealing section 9 of the sealing member 7 restores to its original form. At this time, some ink may adhere to the inner circumferential surface 14C of the ink feed port 14A as it has been guided to the filter from the absorbing body 15 when the ink cartridge was attached. However, if the amount of attached ink is small, this ink 20 will be absorbed by the absorbing body 15 to keep the sealing member 7 in a clean condition without ink stains. Moreover, the inner circumferential surface 14C of the ink feed port 14A is sealed so the ink does not leak to the outer surface 14B of the ink cartridge 14.

As described above, the ink sealing section 9 of the sealing member 7 provided along the outer peripheral surface of the ink guide section 2A extends to the outside of the ink guide section 2A opposite the ink feed port 14A. Thus, the inner circumferential surface 14C of the ink feed port 14A is sealed by the ink sealing section 9 as the ink cartridge 14 is attached to the head holder 2. Moreover, when the ink cartridge 14 is detached from the head holder 2, the ink feed port 14A is kept sealed until the ink sealing section 9 is separated from the ink feed port 14A to prevent ink from leaking out from the juncture. Furthermore, since the ink sealing section 9 covers the ink guide section 2A, it is possible to prevent the ink guide section 2A from being stained with ink. Thus, the inside or vicinity of the printer can be kept clean without ink stains to provide the printer with an improved appearance. Thus, the hands or clothes of the operator can be kept free from being stained with ink.

The present invention is not limited to the above embodiment and is subject to various modifications without departing from the scope of the invention. For instance, although the inside of the ink sealing section 9A is described as being formed almost vertically with respect to the ink guide section 2A, it may be tapered with its opening facing the ink cartridge 14.

Figure 4:
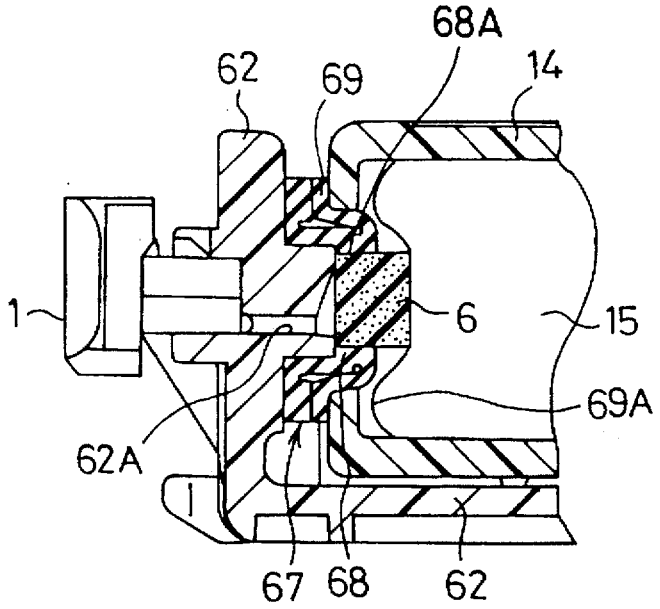
FIG. 4 is a cross-sectional view showing an ink cartridge in a second embodiment of the present invention when attached to a head holder.
Figure 5:
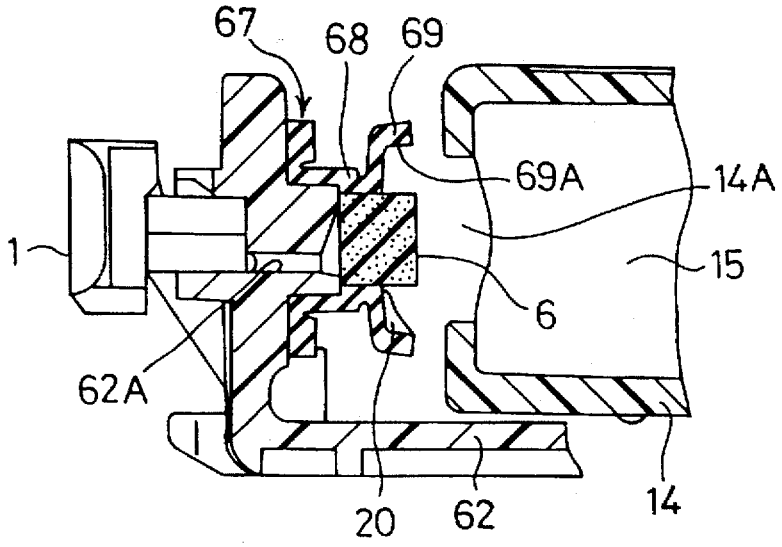
FIG. 5 is a cross-sectional view showing the ink cartridge in the second embodiment after having been detached from the head holder.
Figure 6:
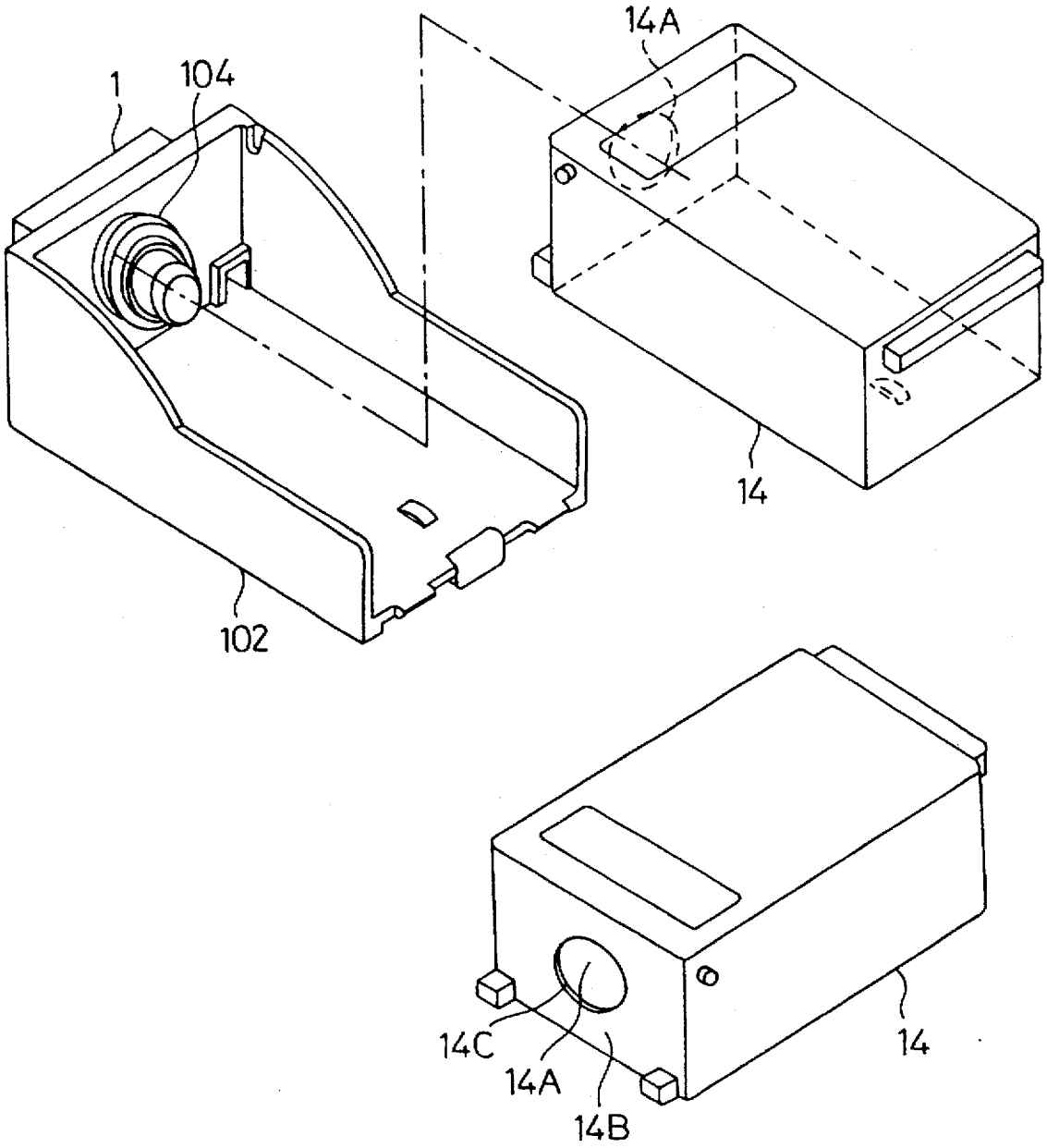
Fig.6 PRIOR ART
FIG. 6 is a block diagram showing an ink feed connecting member and an ink cartridge of a head holder in a conventional example.
Figure 7:
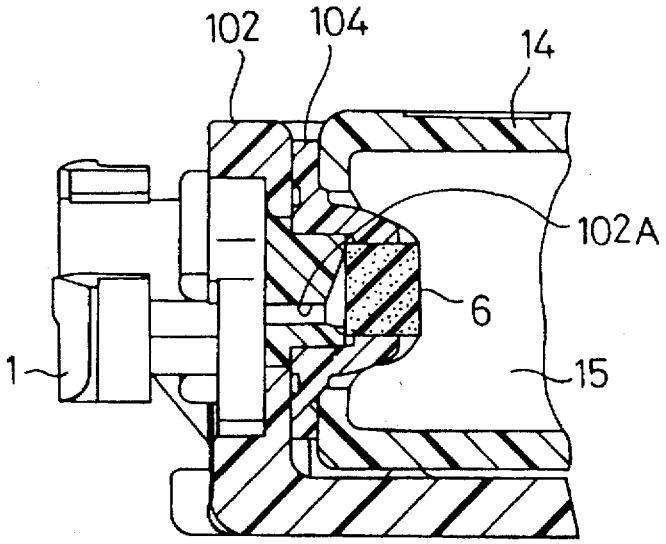
Fig.7 PRIOR ART
FIG. 7 is a cross-sectional view showing the conventional ink cartridge when attached to the head holder.
Figure 8:
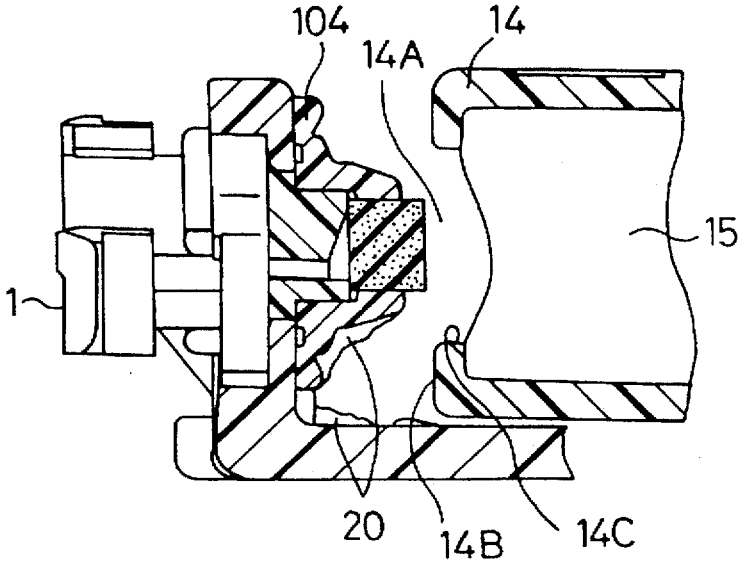
Fig.8 PRIOR ART
FIG. 8 is a cross-sectional view showing the conventional ink cartridge when detached from the head holder.

A second preferred embodiment of the present invention will now be explained. The same reference numerals are provided to designate the corresponding features in the first embodiment and the explanation thereof will be omitted for brevity. As shown in FIGS. 4 and 5, the recording head 1 is fixed to a head holder 62. The head holder 62 is integrally provided with an ink feed path 62A for supplying ink to the recording head 1. An ink feed connecting member 67 is provided to cover the end of the ink feed path 62A. The ink feed connecting member 67 is made of rubber or resins possessing the appropriately elasticity. Moreover, the ink feed connecting member 67 should preferably be sufficiently durable with respect to the ink.

The ink feed connecting member 67 comprises an ink guide section 68 that is insertable into the ink cartridge 14 from the ink feed port 68A and an ink receiver 69 surrounding the ink guide section 68. The ink guide section 68 includes an ink guide port 68A for introducing ink to the recording head 1 through the ink feed path 62A. The porous member 6 is provided at the end of the ink guide port 14A to which the ink cartridge 14 is attached (see FIG. 4). The ink receiving section 69 is formed to have such flexibility that it can easily deform upon receipt of pressure and to have such restoring force that it can promptly restore its original shape when pressure is eliminated. In the second embodiment, the ink feed connecting member 67 includes the ink guide section 68 and the ink receiver 69 integrated together.

A further detailed explanation will now be given of the ink feed connecting member. When the ink cartridge 14 is not attached to the head holder 62, the ink receiving section 69 appears substantially U-shaped as viewed in cross section and surrounds the ink guide section 68 such that an opening of the ink receiving section 69 is opposite the ink cartridge 14. The peripheral edge of the opening of the ink receiving section 69 has a sufficiently greater diameter than the ink feed port 14A of the ink cartridge 14.

When the ink cartridge 14 is attached to the head holder, the ink receiving section 69 is pressed against the circumferential edge of the ink feed port 14A so the circumferential edge of the ink receiving section 69 is invertedly deformed. As the ink receiving section 69 is further pressed, the ink guide section 68 and the inside of the invertedly deformed ink receiving section 69 fit into the ink feed port 14A and further enter the ink cartridge 14. When the ink cartridge 14 is fully attached to the head holder, the inner peripheral surface of the inverted circumferential edge of the ink receiving section 69 seals the ink feed port 14A. In particular, since the ink receiving section 69 attempts to return to its original form due to its restoring force even while being invertedly deformed, the inner peripheral surface 69A of the circumferential edge of the ink receiving section 69 comes in contact with the circumferential edge of the ink feed port 14A. Therefore, ink drops from the juncture between the head holder 62 and the ink cartridge 14 are unlikely to occur.

When the ink guide section 68 and the inner side portion of the ink receiving section 69 enter the ink cartridge 14, the porous member 6 and the inner peripheral surface 69A of the receiving section compress the absorbing body 15 housed in the ink cartridge 14. The receipt of compressive force causes the density of the absorbing body 15 in the vicinity of the porous member 6 to be increased to bring about capillary action. This capillary action causes the ink contained in the absorbing body 15 to be collected to the porous member 6 to further guide the ink from the porous member 6 to the feed path 62A (See FIG. 4).

As shown in FIG. 5, when the ink cartridge 14 is detached from the head holder, the ink receiving section 69 of the ink feed connecting member 67 in the state shown in FIG. 4 is inverted again and restores to its original form. At this time, some ink adheres to the inner peripheral surface 69A of the ink receiving section 69. However, if the amount of the ink is small, this ink 20 will flow along the restored inner peripheral surface 69A to the ink guide section 68 and will be absorbed by the porous member 6. In this way, the ink feed connecting member 67 is kept in a clean condition without ink stains. Furthermore, the ink receiving section 69 has a U-shaped bent portion along its peripheral edge. Hence, even if a large quantity of ink 20 adheres to the inner peripheral surface 69A, the inner peripheral surface 69A along the circumferential edge of the ink receiving section 68 will retain the ink 20 to prevent leakage of ink.

The present invention is not limited to the above embodiments and can be subjected to various modifications without departing from the scope of the invention. For example, the opening edge of the ink receiving section 69 in the second embodiment is formed parallel to the direction in which the ink cartridge 14 is attached. However, to improve the force for retaining the ink 20, the opening edge may be inwardly directed to the center axis.

In addition, the inner peripheral surface 69A of the ink receiving section 69 is substantially perpendicular to the ink guide 68. However, the inner peripheral surface 69A may be tapered with its opening facing the ink cartridge 14.

Further, the leading end of the porous member 6 and the opening edge of the ink receiving section 69 substantially match with each other in the second embodiment. However, the opening edge of the ink receiving section 69 may extend further to the front (toward the ink cartridge 14). With such construction, even if the operator erroneously touches the porous member 6, the hands of the operator will not be stained with ink.

In the second embodiment, the ink feed connecting member 67 is made up of the ink guide section 68 and the ink receiving section 69 made of the same member and integrated together. However, it may be made up of different members assembled into one unit.

Several embodiments of the invention have now been described in detail. It is to be noted, however, that the these descriptions of specific embodiments are merely illustrative of the principles underlying the inventive concept. It is contemplated that various modifications of the disclosed embodiments as well as other embodiments of the invention will be apparent to those skilled in the art without departing from the spirit and scope of the invention.

What is claimed is:

1. An ink feed connecting member for connecting an ink recording head with a detachable ink cartridge having an ink feed port for feeding ink to the recording head, the ink feed port defined by an inner peripheral surface of an opening of the cartridge, the connecting member comprising:

an ink guide having an ink guide port for guiding ink from the ink cartridge to the recording head, said ink guide being insertable into the ink cartridge through the ink feed port; and sealing means for surrounding at least a part of said ink guide and being disposed opposite the ink feed port of the ink cartridge, said sealing means being inverted when fitted into the ink feed port, wherein a surface of the sealing means comes into contact with the inner peripheral surface of the ink feed port when said ink cartridge is attached to said ink feed connecting member.

2. The ink feed connecting member of claim 1, wherein said sealing means is a resilient member.

3. The ink feed connecting member of claim 2, wherein said resilient member is one of thermoplastic rubber and cold setting silicon rubber.

4. The ink feed connecting member of claim 1, wherein said ink guide enters the ink cartridge through the ink feed port when the ink cartridge is attached to the ink recording head and compresses an ink absorbing body provided in the ink cartridge that is impregnated with the ink.

5. The ink feed connecting member of claim 1, wherein the ink guide has a front end and a distance between the front end of said ink guide and said sealing means is less than a distance between the ink feed port of the ink cartridge and an ink absorbing body provided within said ink cartridge.

6. The ink feed connecting member of claim 1, wherein the surface of the sealing section seals with the inner peripheral surface of the ink feed port to prevent leakage of ink when said ink cartridge is attached to said ink feed connecting member.

7. The ink feed connecting member of claim 1, wherein said sealing means is in an original shape when said ink cartridge is detached from said ink feed connecting member and said sealing means is in a different shape when said ink cartridge is attached to said ink feed connecting member.

8. The ink feed connecting member of claim 1, wherein said sealing means prevents an outside surface of said ink guide from receiving ink.

9. The ink connecting member of claim 1, wherein said ink feed guide and said sealing means are integrally formed.

10. The ink feed connecting member of claim 1, wherein said ink guide includes a leading end that faces the ink feed port of said ink cartridge when the ink cartridge is attached to the ink feed connecting member, the ink connecting member further comprising a porous member provided at the leading end of said ink guide.

11. The ink feed connecting member of claim 10, wherein the porous member includes a leading surface, the leading surface of the porous member being substantially aligned with the surface of the sealing means when said ink cartridge is detached from said ink feed connecting member.

12. The ink feed connecting member of claim 1, wherein the surface of the sealing means is substantially parallel with the inner peripheral surface of said ink cartridge when said ink cartridge is attached to said ink feed connecting member and said surface of the sealing means is substantially vertical to said inner peripheral surface of the ink cartridge when the ink cartridge is detached from said ink feed connecting member.

13. The ink feed connecting member of claim 1, wherein the ink guide extends in a longitudinal direction from the ink recording head toward the ink feed port of the ink cartridge, wherein the surface of the sealing means is substantially perpendicular with the longitudinal direction when said ink cartridge is detached from said ink feed connecting member and the surface is substantially parallel with the longitudinal direction when the ink cartridge is attached to said ink feed connecting member.

14. The ink feed connecting member of claim 1, wherein the ink guide includes a filter that is inserted into the ink cartridge when the ink cartridge is attached to the ink feed connecting member.

15. An ink feed connecting member for connecting a head holder having an ink recording head with a detachable ink cartridge having an ink feed port for feeding ink to the recording head, the ink feed port defined by an inner peripheral surface of an opening of the cartridge, the connecting member comprising:

an ink guide having an ink guide port for guiding ink from the ink cartridge to the recording head, said ink guide being insertable into the ink cartridge through the ink feed port; and sealing means for surrounding at least a part of said ink guide, said sealing means being formed into a substantially U-shape structure, said sealing means being disposed such that an opening of said sealing means is opposite the ink feed port of the ink cartridge, said sealing means being inverted when fitted into the ink feed port, wherein an inner surface of the sealing means enters the ink cartridge to seal the ink feed port when the ink cartridge is attached to the ink feed connecting member.

16. The ink feed connecting member of claim 15, wherein said ink guide enters the ink cartridge through the ink feed port when the ink cartridge is attached to said ink feed connecting member.

17. The ink feed connecting member of claim 15, further comprising a porous member provided at the ink guide port, said porous member compresses an ink absorbing body provided in the ink cartridge that is impregnated with the ink when said ink feed connecting member is attached to said ink cartridge.

18. The ink feed connecting member of claim 15, wherein said sealing means is in an original shape when said ink cartridge is detached from said ink feed connecting member and said sealing means is in a different shape when said ink cartridge is attached to said ink feed connecting member.

19. The ink connecting member of claim 15, wherein said ink guide and said sealing means are integrally formed.

20. A printing apparatus comprising:

an ink jet recording head;

a head holder for holding at least the ink jet recording head;

an ink cartridge connectable with the ink jet recording head, the ink cartridge having an ink feed port for feeding ink to the ink jet recording head, the ink feed port defined by an inner peripheral surface of an opening of the ink cartridge; and an ink feed connecting member for connecting the ink jet recording head with the ink cartridge, the connecting member comprising:

an ink guide having an ink guide port for guiding ink from the ink cartridge to the recording head, said ink guide being insertable into the ink cartridge through the ink feed port; and sealing means for surrounding at least a part of said ink guide and being disposed opposite the ink feed port of the ink cartridge, said sealing means being inverted when fitted into the ink feed port, wherein a surface of the sealing means comes into contact with the inner peripheral surface of the ink feed port when said ink cartridge is attached to said ink feed connecting member.

* * * * *